US009944066B2

(12) United States Patent
Ohnishi

(10) Patent No.: US 9,944,066 B2
(45) Date of Patent: Apr. 17, 2018

(54) PRINTED MATTER AND MANUFACTURING METHOD OF PRINTED MATTER

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 123 days.

(21) Appl. No.: 15/076,625

(22) Filed: Mar. 21, 2016

(65) Prior Publication Data

US 2016/0280002 A1 Sep. 29, 2016

(30) Foreign Application Priority Data

Mar. 23, 2015 (JP) ..... 2015-058974

(51) Int. Cl.
*B41J 2/01* (2006.01)
*B44C 1/00* (2006.01)
*B41M 3/00* (2006.01)

(52) U.S. Cl.
CPC ..... *B41J 2/01* (2013.01); *B41M 3/006* (2013.01); *B44C 1/00* (2013.01); *Y10T 428/24802* (2015.01)

(58) Field of Classification Search
CPC ... B41J 2/01; B41M 3/006; B44C 1/00; Y10T 428/24802
See application file for complete search history.

(56) References Cited

U.S. PATENT DOCUMENTS

2012/0210892 A1* 8/2012 Makimoto ..... B41J 2/0057 101/367

FOREIGN PATENT DOCUMENTS

JP 08-267714 A * 10/1996 ..... B41F 23/06
JP 2004-351724 12/2004

* cited by examiner

*Primary Examiner* — Betelhem Shewareged
(74) *Attorney, Agent, or Firm* — JCIPRNET

(57) ABSTRACT

A printer matter and manufacturing method thereof are provided. In the printed matter in which a print surface of a medium is decorated by applying a powdery decorative body on the print surface of the medium, an application region of the powdery decorative body on the print surface of the medium is colored by a color that is the same or similar to a color of the powdery decorative body. Due to this, in the printed matter, in the case of drawing a letter or a drawing and the like on the print surface of the medium using the powdery decorative body, the entire image and the contours of the letter or the drawing and the like can be made clear by the color given to the application region for the powdery decorative body.

7 Claims, 6 Drawing Sheets

PRINTED MATTER AND MANUFACTURING METHOD OF PRINTED MATTER

CROSS REFERENCE TO RELATED APPLICATIONS

This application claims the priority benefit of Japanese Patent Application No. 2015-058974, filed on Mar. 23, 2015. The entirety of the above-mentioned patent application is hereby incorporated by reference herein and made a part of this specification.

TECHNICAL FIELD

The present disclosure relates to a printed matter in which a print surface of a medium is decorated. Further, the present disclosure relates to a manufacturing method of such a printed matter.

DESCRIPTION OF THE BACKGROUND ART

Conventionally, a flocked printed matter which is formed by printing a pattern of a letter or a drawing on a base paper by an adhesive agent, and flocking colored flock powder in the adhesive agent has been known (for example, see Patent Document 1).

[Patent Document 1] JP 2004-351724 A

SUMMARY

In general, flock powder is not adhered very well, so it is difficult to surely apply the flock powder to an entirety of a region where the adhesive agent has been applied in the flocked printed matter described in Patent Document 1. Thus, in drawing a letter or a drawing by using the flock powder in the flocked printed matter described in Patent Document 1, it is difficult to make the entire image of the letter or the drawing clear by the flock powder. Further, in the flocked printed matter described in Patent Document 1, in the case of drawing a letter or a drawing using the flock powder, it is difficult to make contours of the letter or the drawing clear by the flock powder. Due to the above reasons, in the flocked printed matter described in Patent Document 1, the letter or the drawing drawn on the base paper is blurred when drawing the letter or the drawing by using the flock powder, so it is difficult to clearly express the letter or the drawing to be drawn on the base paper.

Thus, the present disclosure provides a printed matter in which a letter or a drawing and the like can be expressed clearly even in the case of drawing the letter or the drawing on a print surface of a medium by using a powdery decorative body. Further, the present disclosure provides a manufacturing method of such a printed matter.

Therefore, a printed matter of the present disclosure is provided. The printed matter is a printed matter in which a print surface of a medium is decorated by applying a powdery decorative body on the print surface of the medium, wherein an application region of the powdery decorative body on the print surface of the medium is colored by a color that is the same or a similar to a color of the powdery decorative body.

In the printed matter of the present disclosure, the color that is the same or a similar to the color of the powdery decorative body is given to the application region of the powdery decorative body on the print surface of the medium. Due to this, in the present disclosure, in the case of drawing a letter or a drawing on the print surface of the medium using the powdery decorative body, an entire image of the letter or the drawing and the like can be made clear by the color applied to the application region even if the powdery decorative body could not surely be applied to the entirety of the application region. Further, in the present disclosure, in the case of drawing a letter or a drawing on the print surface of the medium by using the powdery decorative body, contours of the letter or the drawing and the like can be made clear by the color applied to the application region even if the contours of the letter or the drawing and the like could not be made clear by the powdery decorative body. Accordingly, in the present disclosure, even in the case of drawing a letter or a drawing and the like on the print surface of the medium using the powdery decorative body, the letter or the drawing and the like to be drawn can be expressed clearly.

In the present disclosure, for example, the powdery decorative body may be fibrous powder for flocking or metallic powder. Further, in the present disclosure, for example, an ink having adhesion may be applied to the application region on the print surface of the medium, the powdery decorative body may be adhered to the ink, and a color of the ink and the color of the powdery decorative body are the same colors or similar colors.

In the present disclosure, for example, an absolute value of a color difference $\Delta E$ in a CIE1976L*a*b* color space between the color of the application region on the print surface of the medium and the color of the powdery decorative body may be equal to or less than 30. Further, in the present disclosure, it is preferable that the absolute value of the color difference $\Delta E$ in the CIE1976L*a*b* color space between the color of the application region on the print surface of the medium and the color of the powdery decorative body be equal to or less than 5. By such configuration, the difference between the color of the application region on the print surface of the medium and the color of the powdery decorative body becomes indistinguishable, so the letter or the drawing and the like to be drawn on the print surface of the medium can be expressed even more aesthetically.

A manufacturing method of a printed matter for manufacturing the printed matter of the present disclosure preferably includes: an ink applying step of applying an ink to an application region on a print surface of a medium by an inkjet printer. By such configuration, a discharged amount of the ink to be applied to the application region on the print surface of the medium can be reduced to a very small amount, so spreading of the applied ink can easily be predicted. Accordingly, the ink can be applied highly accurately to the application region on the print surface of the medium, and as a result, the contours of the letter or the drawing and the like can be drawn highly accurately on the print surface of the medium.

The manufacturing method of the printed matter of the present disclosure preferably includes: an ink semi-curing step of semi-curing the ink after the ink applying step, and an ink complete-curing step of completely curing the ink after having applied a powdery decorative body onto the ink after the ink semi-curing step. By such configuration, even if an ink with relatively low viscosity is applied by the inkjet printer, the ink can be prevented from dripping upon applying the powdery decorative body. Accordingly, the letter or the drawing and the like can be drawn highly accurately on the print surface of the medium.

As above, in the printed matter of the present disclosure, even in the case of drawing a letter or a drawing and the like on the print surface of the medium using the powdery decorative body, the letter or the drawing and the like to be drawn can be expressed clearly. Further, by manufacturing the printed matter using the manufacturing method of the printed matter of the present disclosure, the contours of the letter or the drawing and the like can be drawn highly accurately on the print surface of the medium.

DETAILED DESCRIPTION OF EMBODIMENTS

Hereinbelow, embodiments according to the present disclosure will be described with reference to the drawings.

(Configuration of Printed Matter)

Figure 1:
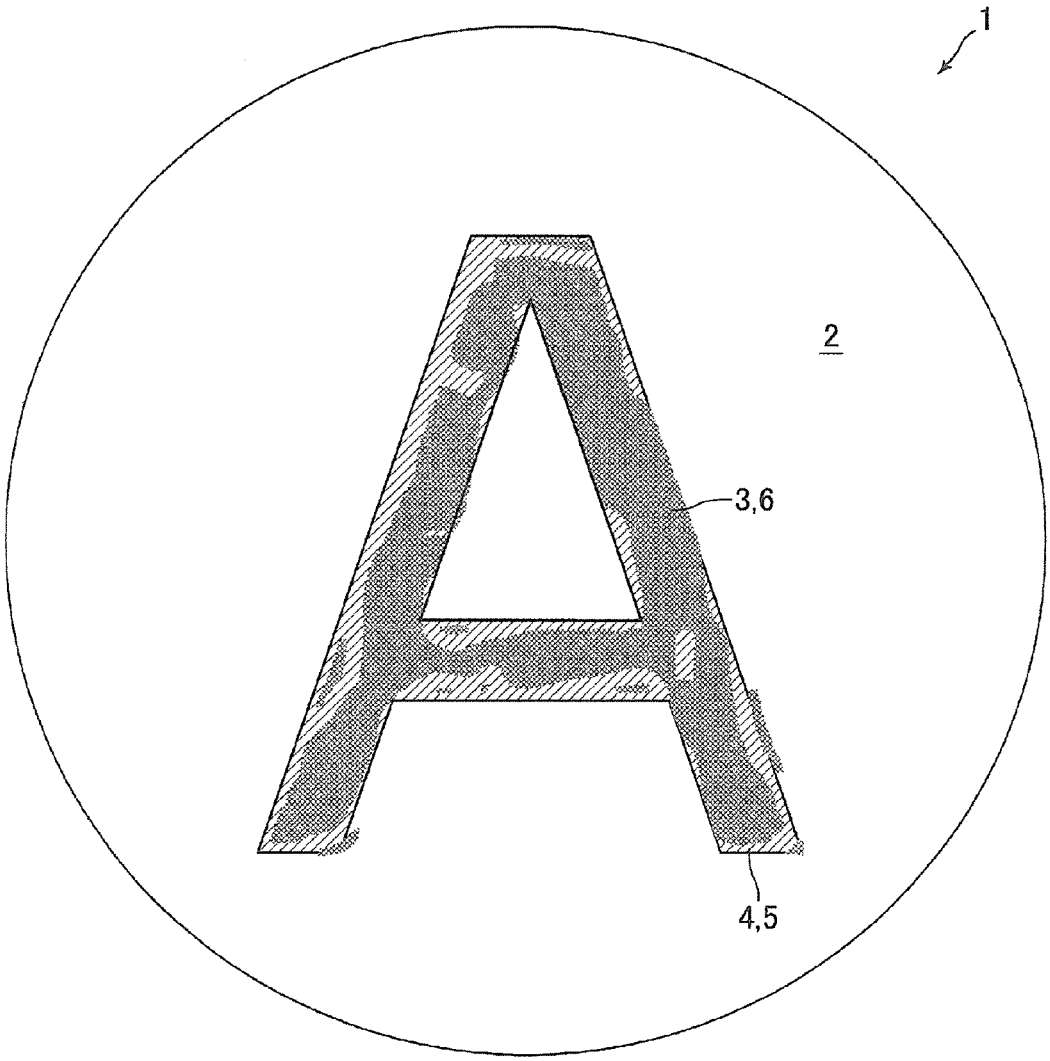
FIG. 1 is a plan view of a printed matter according to an embodiment of the present disclosure.
Figure 2:
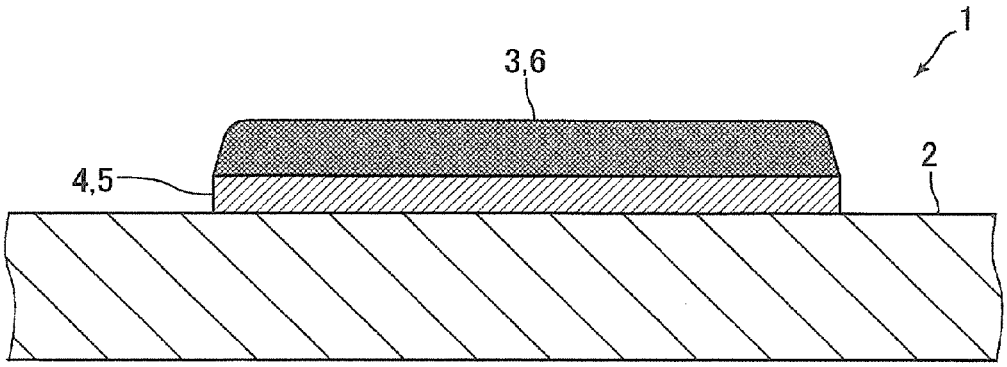
FIG. 2 is a cross sectional view of the printed matter illustrated in FIG. 1 of the present disclosure.

FIG. 1 is a plan view of a printed matter 1 according to an embodiment of the present disclosure. FIG. 2 is a cross sectional view of the printed matter 1 illustrated in FIG. 1.

The printed matter 1 of the present embodiment has a letter, a drawing (figure) and/or a pattern and the like drawn on a print surface of a medium 2 for being used in printing. In this printed matter 1, the print surface of the medium 2 is decorated by being adhered a powdery decorative body 3 on the print surface of the medium 2. The printed matter 1 includes: the medium 2 for being used in printing, an ink layer 5 being a layer of an ink 4 for being adhered the powdery decorative body 3 on the print surface of the medium 2, and a decorative layer 6 being a layer of the powdery decorative body 3. The medium 2 is a medium made of resin or paper and the like. For example, the medium 2 of the present embodiment is a cover for a smart phone, and is made of resin material.

The powdery decorative body 3 of the present embodiment is fibrous powder for flocking, and is formed of natural plant fiber, synthetic fiber, or a mixture of the natural plant fiber and the synthetic fiber, and the like. The powdery decorative body 3 is colored in a color different from a color of the print surface of the medium 2. As a design, a letter, a drawing (figure), a pattern, and the like are to be drawn on the print surface of the medium 2 by using the powdery decorative body 3 (that is, by the decorative layer 6). In the present embodiment, as illustrated in FIG. 1, a letter "A" is to be drawn by the powdery decorative body 3 on the print surface of the medium 2 as the design, and a portion of the print surface of the medium 2 where the letter "A" is to be drawn (portion where the letter "A" is to be formed) is an application region for the powdery decorative body 3. That is, the portion of the print surface of the medium 2 where the letter, the drawing and/or the pattern and the like are to be drawn (the portion where the letter, the drawing and/or the pattern and the like are to be formed) is the application region for the powdery decorative body 3 in the design.

The ink 4 has adhesion to attach the powdery decorative body 3. The powdery decorative body 3 is adhered onto the ink 4, and the ink layer 5 is arranged between the medium 2 and the decorative layer 6. The ink 4 of the present embodiment is an ink of an UV (ultraviolet) curing ink. For example, the ink 4 is an UV curing ink specified by a type no. "LH-100", manufactured by MIMAKI ENGINEERING CO., LTD. This ink 4 loses its adhesion when it is completely cured. The ink 4 is applied to the application region of the print surface of the medium 2 for the powdery decorative body 3. That is, the ink 4 is applies to the portion within the print surface of the medium 2 where the letter "A" is to be formed. The ink 4 is colored ink, and the color of the ink 4 and a color of the powdery decorative body 3 are the same colors or similar colors. Due to this, the color that is the same or similar to the color of the powdery decorative body 3 is applied to the application region of the print surface of the medium 2 for the powdery decorative body 3.

In the present embodiment, an absolute value of a color difference $\Delta E$ in a CIE1976L*a*b* color space between the color of the ink 4 and the color of the powdery decorative body 3 is equal to or less than 30. That is, the absolute value of the color difference $\Delta E$ in the CIE1976L*a*b* color space between the color of the application region on the print surface of the medium 2 for the powdery decorative body 3 and the color of the powdery decorative body 3 is equal to or less than 30. Notably, the CIE1976L*a*b* color space is defined by JIS Z 8781-4.

(Manufacturing Method of Printed Matter)

FIGS. 3A~3D are diagrams for describing a manufacturing method of the printed matter 1 illustrated in FIG. 1.

Figure 3C:
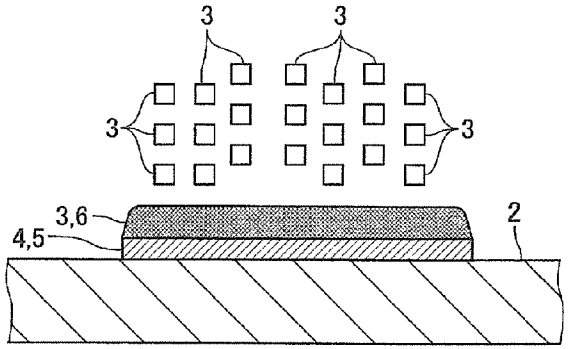
FIGS. 3A~3D are diagrams for describing a manufacturing method of the printed matter illustrated in FIG. 1 of the present disclosure.
Figure 3D:
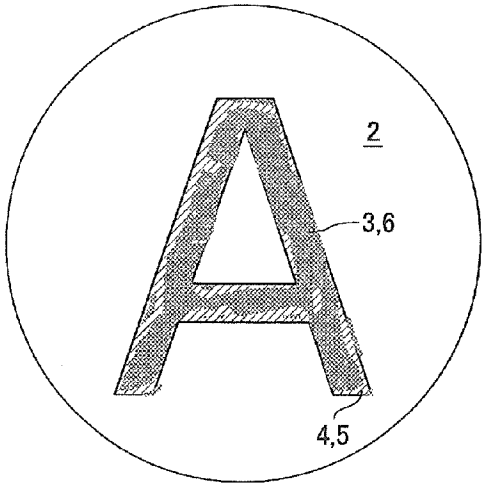
Figure 3A:
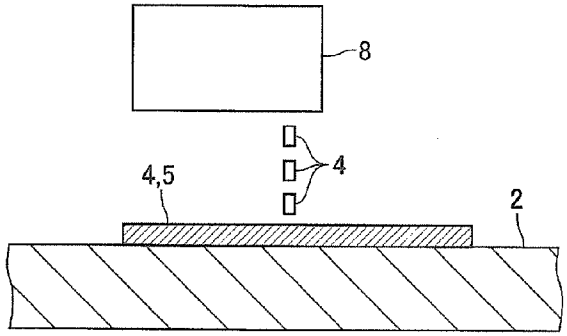
Figure 3B:
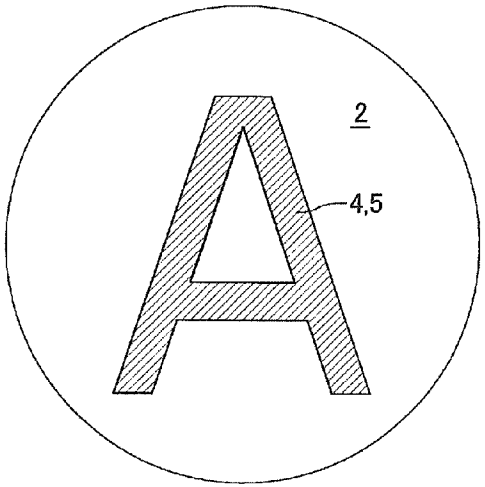

In manufacturing the printed matter 1, firstly, the ink 4 is applied to the print surface of the medium 2 to form the ink layer 5 (an ink applying step). In the ink applying step, the ink 4 is applied to the print surface of the medium 2 by an inkjet printer. For example, as illustrated in FIG. 3A, the ink 4 is discharged from an inkjet head 8 arranged above the medium 2 onto the medium 2 to apply the ink 4 on the print surface of the medium 2, and the ink layer 5 is thereby formed on the print surface of the medium 2. Further, in the ink applying step, as illustrated in FIG. 3B, the ink 4 is applied to the portion of the print surface of the medium 2 where the letter "A" is to be formed. The inkjet head 8 includes a plurality of nozzles for discharging ink of basic colors, for each of cyan, magenta, yellow, and black, and the color of the ink 4 applied to the print surface of the medium 2 is adjusted by a mixing ratio of the basic colors of cyan, magenta, yellow, and black discharged from the nozzles of the inkjet head 8.

In addition, an ink 4 that is adjusted to a predetermined color may be discharged from the nozzles of the inkjet head 8. Further, in general, light-colored ink 4 is applied onto the print surface of the medium 2 by reducing the amount of the ink 4 discharged from the inkjet head 8, however, the light-colored ink 4 may be applied onto the print surface of the medium 2 without reducing the amount of the ink 4 discharged from the inkjet head 8 by mixing a transparent ink (a clear ink). In this case, the amount of the ink 4 discharged from the inkjet head 8 can be maintained constant even in the case of applying the light-colored ink 4 onto the print surface of the medium 2, so a decrease in a property to being adhered the powdery decorative body 3 can be prevented.

Thereafter, the ink 4 that is applied onto the print surface of the medium 2 in the ink applying step is semi-cured (an ink semi-curing step). Specifically, the ink 4 is semi-cured (semi-dried) so that the viscosity of the ink 4 becomes equal to or greater than 200 mPa·sec. Thereafter, as illustrated in FIGS. 3C and 3D, the powdery decorative body 3 is sprinkled on the surface of the ink layer 5 and have the powdery decorative body 3 adhere to the ink 4 (that is, the flock powder is flocked in the ink layer 5), and a decorative layer 6 is thereby formed on the surface of the ink layer 5. At this occasion, the powdery decorative body 3 is sprinkled even to portions of the print surface of the medium 2 that are outside the ink layer 5. Thereafter, the decorative layer 6 is pressed onto the ink layer 5 to fix the powdery decorative body 3 in the ink 4, and the excessive powdery decorative body 3 is thereafter shaken off. Thereafter, ultraviolet ray is irradiated onto the ink layer 5 to completely be cured the ink 4 (ink complete-curing step). Thereafter, after the excessive powdery decorative body 3 is shaken off, the manufacture of the printed matter 1 is completed.

(Primary Effects of the Present Embodiment)

As described above, in the present embodiment, the ink 4 that is of the same color or of the similar color as the color of the powdery decorative body 3 is applied to the application region of the print surface of the medium 2 for the powdery decorative body 3, and the color that is of the same color or of a similar color as the color of the powdery decorative body 3 is applied to the application region of the print surface of the medium 2 for the powdery decorative body 3. Due to this, in the present embodiment, in the case of drawing the letter or the drawing and the like on the print surface of the medium 2 by using the powdery decorative body 3, as illustrated in FIG. 1, even if the powdery decorative body 3 could not be adhered to an entirety of the application region for the powdery decorative body 3 (entirety of the portion where the letter "A" is to be formed), the color given to the application region for the powdery decorative body 3 (that is, the color of the ink 4) can make the entire image of the letter or the drawing and the like clear. Specifically, the entire image of the letter "A" can be made clear. Further, in the present embodiment, in the case of drawing the letter or the drawing and the like on the print surface of the medium 2 by using the powdery decorative body 3, the contours of the letter or the drawing and the like can be made clear as illustrated in FIG. 1 by the color applied to the application region for the powdery decorative body 3 even if the contours of the letter or the drawing and the like could not be made clear by the powdery decorative body 3. Specifically, the contour of the letter "A" can be made clear. Accordingly, in the present embodiment, even in the case of drawing the letter or the drawing and the like on the print surface of the medium 2 using the powdery decorative body 3, the letter or the drawing and the like to be drawn can be expressed clearly.

Figure 4A:
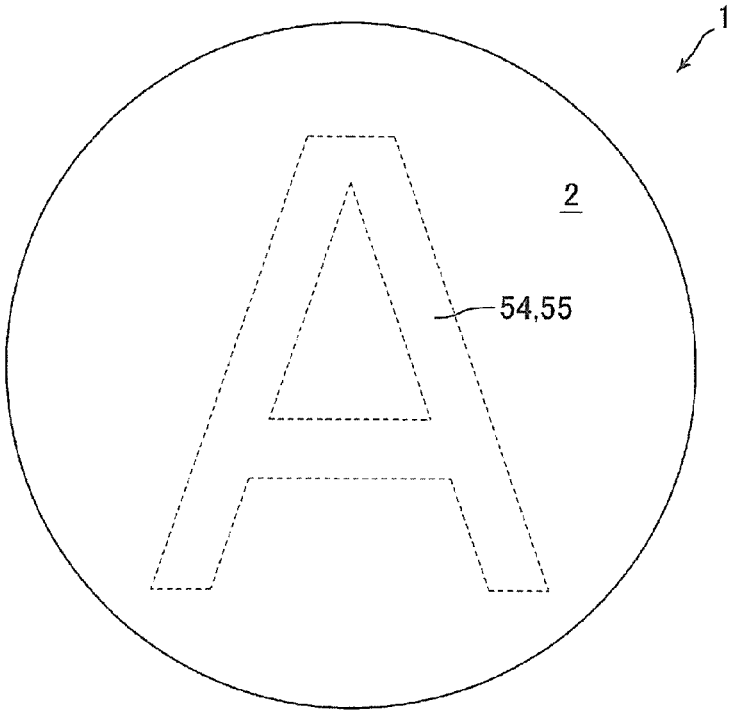
FIGS. 4A and 4B are diagrams for describing an effect of the printed matter illustrated in FIG. 1 of the present disclosure.
Figure 4B:
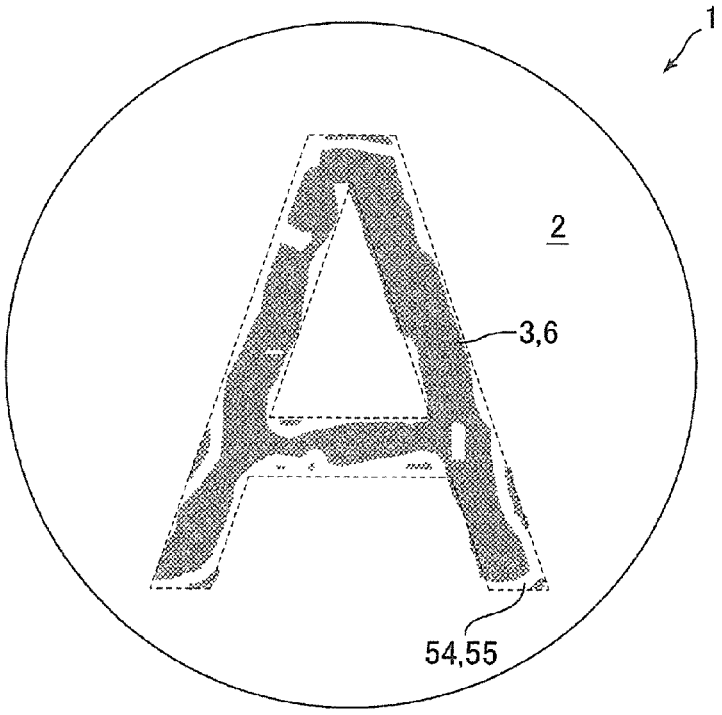

Notably, as illustrated in FIG. 4A, for example, in the case where a transparent ink layer 55 is formed by applying a transparent ink 54 to the application region of the print surface of the medium 2 for the powdery decorative body 3, when the letter or the drawing and the like is drawn on the print surface of the medium 2 by using the powdery decorative body 3, as illustrated in FIG. 4B, the entire image of the letter or the drawing and the like cannot be made clear. Further, the contours of the letter or the drawing and the like also cannot be made clear.

In the present embodiment, the ink 4 is applied to the print surface of the medium 2 by the inkjet printer. Due to this, in the present embodiment, a discharged amount of the ink 4 to be applied to the application region on the print surface of the medium 2 for the powdery decorative body 3 can be reduced to a very small amount, so spreading of the applied ink 4 can easily be predicted. Accordingly, in the present embodiment, the ink 4 can be applied highly accurately to the application region for the powdery decorative body 3, and as a result, the contours of the letter or the drawing and the like can be drawn highly accurately on the print surface of the medium 2.

Further, in the present embodiment, since the ink 4 is completely cured in the ink complete-curing step after having adhered the powdery decorative body 3 to the ink 4 after having semi-cured the ink 4, which had been applied to the print surface of the medium 2, in the ink semi-curing step, the dripping of the ink 4 upon applying the powdery decorative body 3 can be prevented even if the ink 4 with relatively low viscosity is applied by the inkjet printer. Accordingly, in the present embodiment, the letter or the drawing and the like can be drawn highly accurately on the print surface of the medium 2.

Notably, in the present embodiment, the absolute value of the color difference ΔE in the CIE1976L*a*b* color space between the color of the ink 4 and the color of the powdery decorative body 3 is equal to or less than 30, however, the absolute value of the color difference ΔE in the CIE1976L*a*b* color space between the color of the ink 4 and the color of the powdery decorative body 3 is preferably equal to or less than 5. In this case, the difference between the color of the ink 4 and the color of the powdery decorative body 3 becomes indistinguishable, so the letter or the drawing and the like to be drawn on the print surface of the medium 2 can be expressed even more aesthetically.

Other Embodiments

In the aforementioned embodiment, the adhesion of the ink 4 is lost when the ink 4 is completely cured, so the powdery decorative body 3 is adhered to the ink 4 by sprinkling the powdery decorative body 3 on the surface of the ink layer 5 after having semi-cured the ink 4 applied to the print surface of the medium 2 in the ink applying step, and thereafter completely curing the ink 4. Other than this, for example, in the case of using ink 4 that maintains its adhesion even after it is completely cured, the powdery decorative body 3 may be adhered to the ink 4 by sprinkling the powdery decorative body 3 on the surface of the ink layer 5 after having completely cured the ink 4 that had been applied to the print surface of the medium 2 in the ink applying step. The ink 4 in this case is for example an UV curing ink specified by a type no. "PR-100", manufactured by MIMAKI ENGINEERING CO., LTD. Further, in the case of the viscosity of the ink 4 is relatively high, the powdery decorative body 3 may be adhered to the ink 4 by sprinkling the powdery decorative body 3 on the surface of the ink layer 5 without semi-curing the ink 4 that had been applied to the print surface of the medium 2 in the ink applying step, and thereafter the ink 4 is completely cured.

In the aforementioned embodiment, the ink 4 is a UV curing ink, but the ink 4 may be active energy beam-curing ink that cures by irradiating active energy beam other than the ultraviolet ray. The ink 4 in this case may be an ink diluted by solvent. Further, the ink 4 may be latex ink, or may be aqueous ink containing a thermal curing resin or a solvent ink.

Figure 5A:
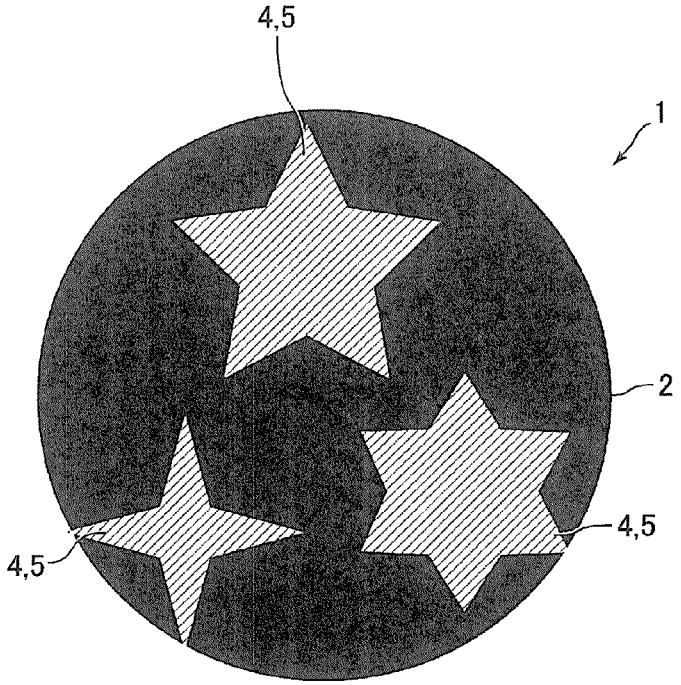
FIGS. 5A and 5B are diagrams for describing a manufacturing method of a printed matter according to another embodiment of the present disclosure.

In the aforementioned embodiment, the powdery decorative body 3 is the fibrous powder for flocking, however, the powdery decorative body 3 may be metallic powder. For example, the powdery decorative body 3 may be metallic powder having a base color of gold, silver, or the like, or, may be metallic powder colored gold, silver, or the like. In this case, in manufacturing the printed matter 1, for example, as illustrated in FIG. 5A, the ink 4 that is of the same color or of a similar color as the color of the powdery decorative body 3 is applied by the inkjet printer to the portion colored black on the print surface of the medium 2 to form the ink layer 5. Thereafter, similar to the aforementioned embodiment, the powdery decorative body 3 is adhered to the ink 4 by sprinkling the powdery decorative body 3 onto the surface of the ink layer 5, and form the decorative layer 6 on the surface of the ink layer 5 (see FIG. 5B).

Figure 5B:
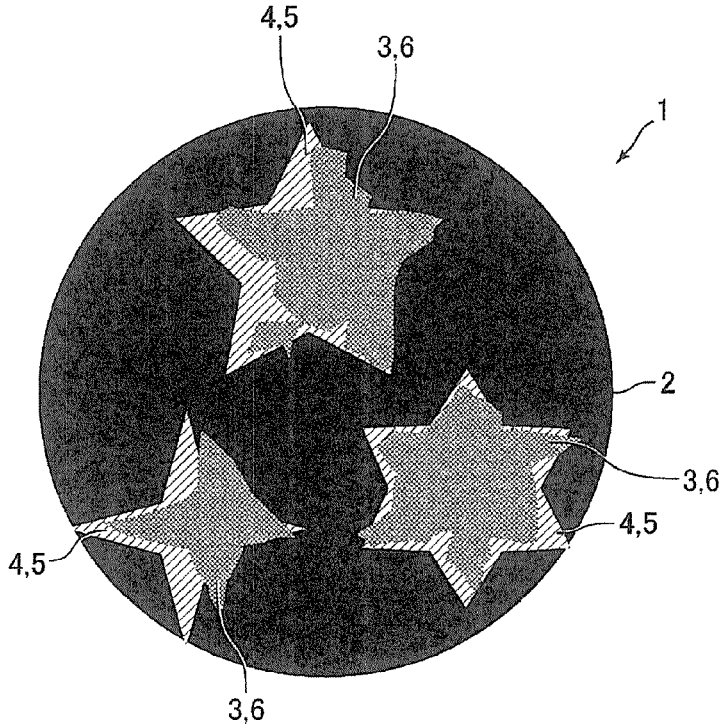
Figure 6:
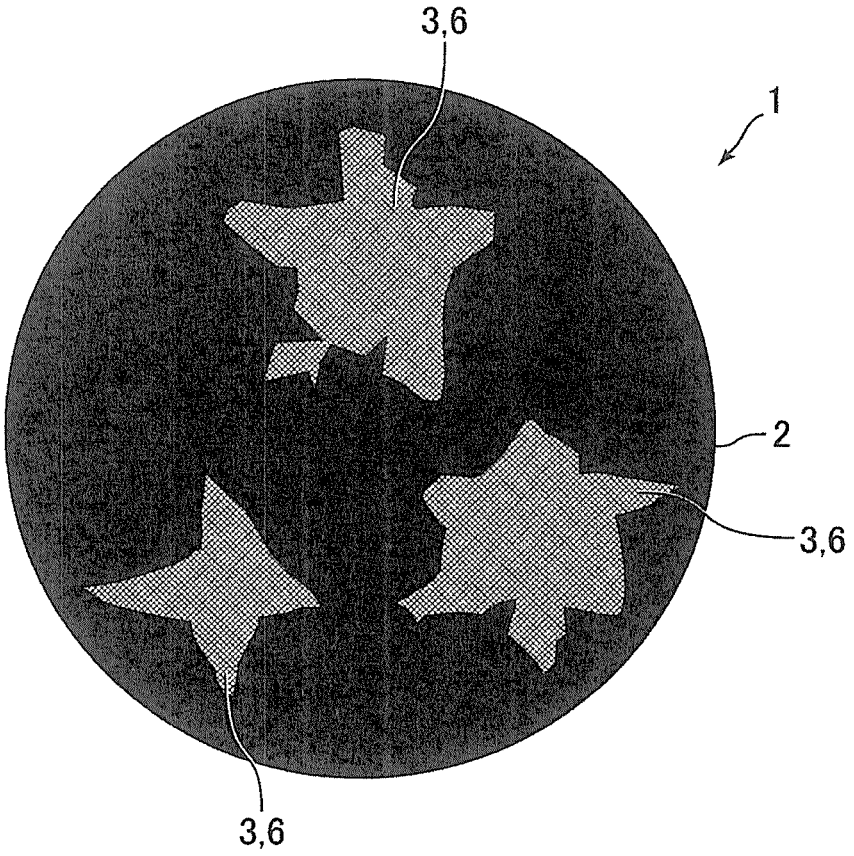
FIG. 6 is a diagram for describing an effect of the printed matter illustrated in FIG. 5B of the present disclosure.

In this case, as illustrated in FIG. 5B, even if the powdery decorative body 3 cannot be adhered to the entirety of the application region for the powdery decorative body 3 (entirety of a portion where a star shape or the like is to be formed), the entire image of the letter or the drawing and the like can be made clear by the color given to the application region for the powdery decorative body 3, and even if the contours of the letter or the drawing and the like cannot be made clear by the powdery decorative body 3, the contours of the letter or the drawing and the like can be made clear by the color given to the application region for the powdery decorative body 3. Specifically, the entire image and the contours of the star shape and the like can be made clear. Accordingly, the same effects as those of the aforementioned embodiment can be achieved. Notably, in the example illustrated in FIGS. 5A and 5B, in the case where a transparent ink layer is formed by applying transparent ink to the application region of the print surface of the medium 2 for the powdery decorative body 3, when the letter or the drawing and the like is drawn on the print surface of the medium 2 using the powdery decorative body 3, as illustrated in FIG. 6, the entire image and the contours of the letter or the drawing and the like cannot be made clear.

Further, in the case where the powdery decorative body 3 is the metallic powder, a transparent or light-colored protection layer covering at least a part of the surface of the decorative layer 6 may be formed. Further, in the example illustrated in FIGS. 5A and 5B, the ink layer 5 is formed over the entirety of the figure in the star shape and the like (entirety of the portions shown in hatched lines in FIG. 5A), however, the ink layer 5 may be formed at a part of the figure. In this case, the powdery decorative body 3 adheres to the portion where the ink layer 5 is formed. Further, the powdery decorative body 3 may be powder of a substance having fluorescence, or may be powder of a substance having phosphorescence. Further, the powdery decorative body 3 may be powdered mica.

What is claimed is:

1. A printed matter being a printed matter in which a print surface of a medium is decorated by applying a powdery decorative body on the print surface of the medium, wherein an application region of the powdery decorative body on the print surface of the medium is colored by a color that is the same or similar to a color of the powdery decorative body, wherein the powdery decorative body is fibrous powder for flocking or metallic powder.

2. The printed matter according to claim 1, wherein an ink having adhesion is applied to the application region on the print surface of the medium, the powdery decorative body is adhered to the ink, and a color of the ink and the color of the powdery decorative body are the same colors or similar colors.

3. The printed matter according to claim 1, wherein an absolute value of a color difference ΔE in a CIE1976L*a*b* color space between a color of the application region on the print surface of the medium and a color of the powdery decorative body is equal to or less than 30.

4. The printed matter according to claim 2, wherein an absolute value of a color difference ΔE in a CIE1976L*a*b* color space between a color of the application region on the print surface of the medium and a color of the powdery decorative body is equal to or less than 30.

5. The printed matter according to claim 3, wherein the absolute value of the color difference ΔE in the CIE1976L*a*b* color space between the color of the application region on the print surface of the medium and the color of the powdery decorative body is equal to or less than 5.

6. A manufacturing method of a printed matter, comprising:

providing the printed matter described in claim 2; and performing an ink applying step of applying the ink to the application region on the print surface of the medium by an inkjet printer.

7. The manufacturing method according to claim 6, further comprising:

performing an ink semi-curing step of semi-curing the ink after the ink applying step; and performing an ink complete-curing step of completely curing the ink after having applied the powdery decorative body onto the ink after the ink semi-curing step.

* * * * *